United States Patent [19]

Takeda et al.

[11] 4,287,449

[45] Sep. 1, 1981

[54] LIGHT-ABSORPTION FILM FOR REAR ELECTRODES OF ELECTROLUMINESCENT DISPLAY PANEL

[75] Inventors: Mikio Takeda; Hiroshi Kishishita, both of Nara; Hiroyuki Kawabata; Kinichi Isaka, both of Tenri, all of Japan

[73] Assignee: Sharp Kabushiki Kaisha, Osaka, Japan

[21] Appl. No.: 8,186

[22] Filed: Jan. 31, 1979

[30] Foreign Application Priority Data

| | | | |
|---|---|---|---|
| Feb. 3, 1978 | [JP] | Japan | 53-11592 |
| Feb. 9, 1978 | [JP] | Japan | 53-14402 |
| Jun. 2, 1978 | [JP] | Japan | 53-67095 |

[51] Int. Cl.[3] ..... H05B 33/14; H05B 33/22

[52] U.S. Cl. ..... 313/509; 313/510

[58] Field of Search ..... 313/506, 509, 510

[56] References Cited

U.S. PATENT DOCUMENTS

| | | | |
|---|---|---|---|
| 2,933,602 | 4/1960 | Gillson, Jr. | 313/509 X |
| 3,046,432 | 7/1962 | Nehrich, Jr. | 313/509 |
| 3,201,633 | 8/1965 | Lieb | 313/509 |
| 4,099,091 | 7/1978 | Yamazoe et al. | 313/509 |
| 4,143,297 | 3/1979 | Fischer | 313/509 X |

*Primary Examiner*—Palmer C. Demeo

*Attorney, Agent, or Firm*—Birch, Stewart, Kolasch and Birch

[57] ABSTRACT

At least one light-absorption layer is disposed between a thin electroluminescent film and a counter electrode for absorbing light applied through a transparent electrode. According to the light-absorption layer, less light is reflected by the counter electrode, thereby preventing a visual contrast provided by electroluminescence, from lowering owing to the reflected light. A plurality of light-absorption layers may be formed in the same arrangement. Materials useful for the light-absorption layers are $Al_2O_3$, $Al_2O_{3-x}$, Mo, Zr, Ti, Y, Ta, Ni, Al or the like with a thickness of about 10–300 A.

9 Claims, 7 Drawing Figures

LIGHT-ABSORPTION FILM FOR REAR ELECTRODES OF ELECTROLUMINESCENT DISPLAY PANEL

BACKGROUND OF THE INVENTION

The present invention relates in general to an electroluminescent display panel and, more particularly, to a non-reflective film for counter electrodes of a thin-film electroluminescent display panel.

The conventional thin-film electroluminescent display panel such as disclosed in U.S. Pat. No. 3,967,112 "Photo-Image Memory Panel and Activating Method Thereof" by Kanatani et al issued on June 29, 1976, assigned to the same assignee contained a plurality of thin films which showed good transparency. In the case where the cunter electrodes reflected the incident radiation, the reflected incident radiation tended to interfere with the electroluminescence generated, thereby inevitably reducing the contrast of the visual images. It has been, therefore, long desired to produce counter electrodes which have nonreflective properties in addition to a high conductivity.

OBJECTS AND SUMMARY OF THE INVENTION

Accordingly, it is an object of the invention to provide an improved thin-film electroluminescent display panel whereby visual display contrast is enhanced.

It is a further object of the invention to provide an improved thin-film electroluminescent display panel where reflection properties are lowered for induced radiation.

It is a further object of the invention to provide an improved thin-film electroluminescent display panel including a plurality of counter electrodes each of which is formed on at least one light-absorption layer.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, an electroluminescent display panel includes a plurality of counter electrodes each of which is formed on at least one light-absorption layer. The light-absorption layer is comprised of a layer of $Al_2O_3$, $Al_2O_{3-x}$ or Mo with a thickness of about 50–300 Å. Other materials such as Zr, Ti, Y, Ta, Ni, or the like may replace the above specified material.

In another preferred form of the present invention, the light-absorption layer contains a pluraity of layers which are made according to the subsequent evaporation step, each with a thickness of about 10–250 Å. Preferably, two to five layers can be included in the light-absorption layer. Additional layers may result in the improvement of the absorption of radiation induced from the outside.

In a further preferred form of the present invention, the light-absorption layer comprises a plurality of layers which are respectively made of any materials such as metal, metal oxide, and the like according to the subsequent evaporation step, each with a thickness of about 10–250 Å. The light-absorption layer can include a plurality of layers containing a different material such as metal, metal oxide or the like with a thickness of about 300 Å or less.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
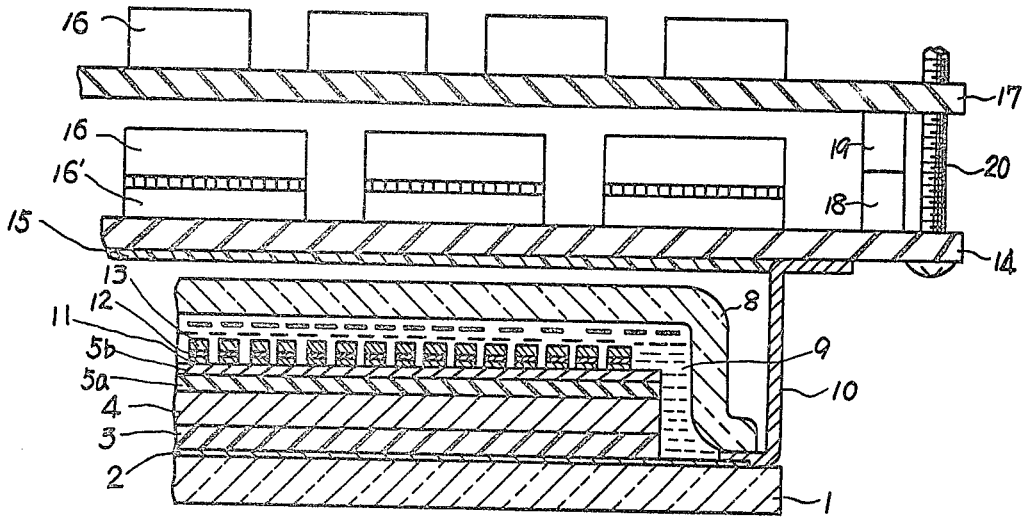
FIG. 1 is a cross-sectional view of a thin-film electroluminescent display panel according to the present invention.

FIG. 1 shows a thin-film electroluminescent display panel of the invention, which comprises a substrate 1, a transparent electrode 2 disposed thereon, a first dielectric layer 3, a thin electroluminescent (referred to as "EL" hereinbelow) film 4, second dielectric layers 5*a* and 5*b*, light-absorption layers 11 and 12, counter electrodes 13, a dish-shaped glass substrate 8, and a protective liquid 9.

The substrate 1 is made of, for example, heat-stable glass material such as Pyrex under the commercial name. The transparent electrode 2 is formed on the substrate 1 being made of $In_2O_3$, $SnO_2$ and the like. The first dielectric layer 3 is made of $Y_2O_3$, $TiO_2$, etc. and is disposed on the transparent electrode 2. The thin EL film 4 is confined by the first dielectrode layer 3 and the second dielectric layer 5*a* and 5*b*. The thin EL film 4 is composed of, for example, ZnS:Mn. The second dielectric layer 5*a* is made of, for example, $Si_3N_4$. The remaining second dielectric layer 5*b* is made of, for example, $Al_2O_3$. The counter electrodes 13, made of, for example, Al is disposed on the second dielectric layer 5*b* through evaporation techniques with a thickness of about 5,000–10,000 A in parallel with the transparent electrode 2.

The first light-absorption layer 11 made of, for example, $Al_2O_{3-x}$ or $Al_2O_3$ is formed on the second dielectric layer 5*b* with a thickness of about 50–100 Å. The material of $Al_2O_{3-x}$ is fabricated under the atmosphere containing only a slight amount of oxygen atoms, and not the complete $Al_2O_3$. The material $Al_2O_{3-x}$ is one kind of alumina oxide showing similar properties to aluminum.

On the first light-absorption layer 11, there is formed the second light-absorption layer 12 made of, for example, Mo with a thickness of about 100–300 Å to enhance the light absorption properties. The incident light is absorbed by the first and second light-absorption layers 11 and 12 which function as a black background in a visual view. The other materials such as Zr, Ti, Y, Ta, Ni, and the like can be substituted for Mo. It is believed that the black background by the first and second light-absorption layers 11 and 12 results from the light interference occurring at the interface between the first and second light-absorption layers 11 and 12.

After layers are formed corresponding to the first and second light-absorption layers 11 and 12 and the counter electrode 13 thereon, over the overall surface of the second dielectric layer 5*b*, desirable patterning procedures such as etching techniques are carried out to produce the first and second light-absorption layers 11 and 12 and the counter electrode 13. The second dielectric layer 5*b* is not subjected to the etching methods and remains unchanged.

The dish-shaped glass substrate 8 is made of soda glass of a thickness of 3 mm, for example. A dent, say, 1 mm deep is formed within the dish-shaped glass substrate 8 for disposing the thin-film EL display unit therein. A lead terminal 10 made of, for example, phosphor Bronze or Cu-Be is connected to the edge of the transparent electrode 2 and the counter electrode 13 for supplying electrical energy thereto. The other edge of the lead terminal 10 is electrically connected to a first circuit board 14 so that the enclosure for the thin-film EL display unit may be supported by the lead terminal 10 away from the first circuit board 14.

On one side of the first circuit board 14 opposed to the package of the thin-film EL display unit, there is formed a background layer 15 of, for example, vinyl resin having a black colorness useful with a background for the thin-film EL display unit. The background layer 15 functions to absorb the light penetrating the space between the adjacent counter electrodes 13. There are disposed a plurality of electronic elements 16 on each of connectors 16' arranged on the other side of the first circuit board 14. The electronic elements 16 comprise integrated circuits (IC) and large integrated circuit (LSI). The electronic elements 16 are arranged by Dualln Line package methods. The electronic elements 16 function to drive the thin-film EL display unit.

A second circuit board 17 is arranged in prallel with and apart from the first circuit board 14. The other electronic elements 16 are similarly disposed on the second circuit board 17. The other electronic elements 16 are provided as well for driving the thin-film EL display unit. Connector terminals 18 and 19 are provided for electrically communicating the first and second circuit boards 14 and 17 with each other. The first and second circuit boards 14 and 17 may comprise a plurality of layers. A screw 20 is provided for mechanically securing the first and second circuit boards 14 and 17.

In terms of a controlling circuit, the power supply is conducted to the transparent electrode 2 and the counter electrode 13 through the lead terminal 10. This results in producing electroluminescence from the thin EL film 4 at selected segments. Even if, external light strikes on the thin-film EL display through the substrate 1, the incident light is absorbed according to the first and second light-absorption layers 11 and 12, thereby reducing the reflected light scattering out of the substrate 1 to enhance the visibility of the electroluminescence.

Figure 2:
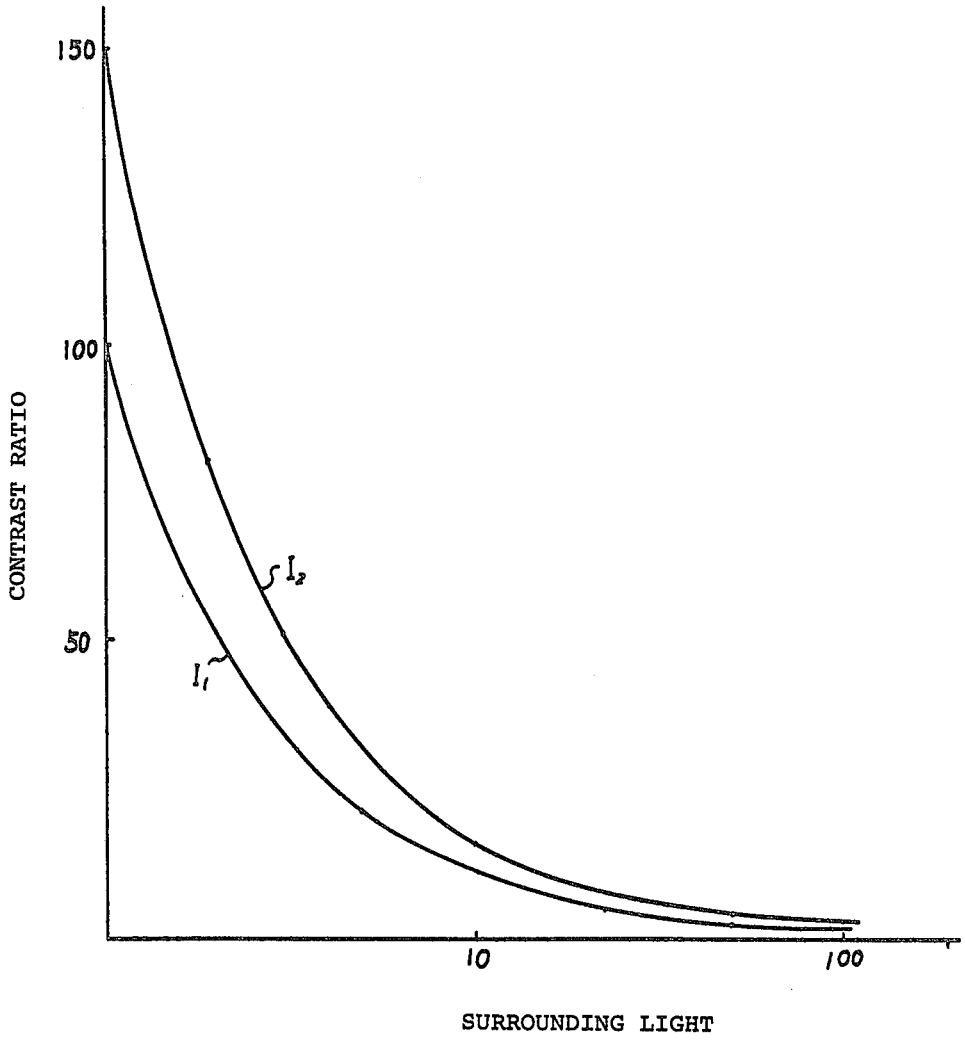
FIG. 2 is a graph showing a constant ratio of the thin-film electroluminescent display panel shown in FIG. 1 and its surrounding light.

FIG. 2 illustrates a graph showing a contrast ratio in the thin-film EL display panel v. surrounding light. The data in FIG. 2 are plotted with the contrast ratio as ordinate and the surrounding light as abscissa. The contrast ratio C can be represented by the formula:

$$C = \frac{A\gamma + B}{A\gamma} = 1 + \frac{B}{A\gamma}$$

where A is the surrounding light (ft-L), B is the brightness of the eectroluminescence (ft-L), and $\gamma$ is reflection coefficient (%).

The data represented by curve $I_1$ are the prior art thin-film EL display panel where the first and second light-absorption layers 11 and 12 are not present. Characteristics in the data denoted by $I_1$ were as follows:

The brightness of the electroluminescence: 50 ft-L

The reflection coefficient: 53.6%

In comparison with the above, the data specified by $I_2$ are concerned with the above-mentioned EL display panel where the first and second light-absorption layers 11 and 12 are provided with a thickness of 70 Å and 100 Å, respectively, and the counter electrode 13 is formed with a thickness of 10,000 Å. Features of the data represented by $I_2$ were as follows:

The brightness of the electroluminescence: 29 ft-L

The reflection coefficient: 18.7%

Figure 3:
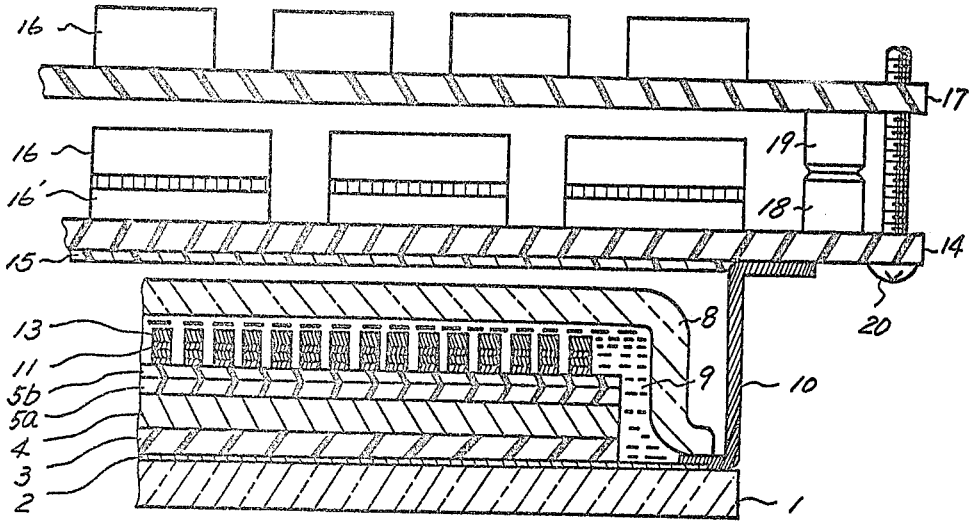
FIG. 3 is a cross-sectional view of another thin-film electroluminescent display panel according to the present invention.

FIG. 3 shows another film-film EL display panel of the present invention which is identical to that as shown in FIG. 1, with the exception that there are used a plurality of light-absorption layers 11 made of the common material in place of the first and second light-absorption layers 11 and 12 each made of the materials unlike in FIG. 1. The poly-fabricated light-absorption layers 11 are made of, for example, $Al_2O_3$ or $Al_2O_{3-x}$ according to the subsequent evaporation and the like. Like elements corresponding to those of FIG. 1 are indicated by like numerals.

Referring to FIG. 3, there are formed three light-absorption layers 11 each made of $Al_2O_{3-x}$ by the subsequent evaporation as described below. At first, a first layer made of $Al_2O_{3-x}$ is deposited on the second dielectric layer 5*b* with a thickness of about 10–50 Å at about 150° C. by vacuum evaporation. The surface of this layer is oxidized by $O_2$ leakage.

Subsequently, a second layer made of $Al_2O_{3-x}$ is further deposited in a similar manner although it is thicker than the first. The second layer is also subjected to oxidation by $O_2$ leakage. Further, a third layer made of $Al_2O_{3-x}$ is formed in a similar manner as described. Each of the first, second and third layers is as thin as about 10–250 Å.

By forming two to five layers each with a thickness of about 10–250 Å, the reflection coefficient of about 14–28% is performed. To further lower the reflection coefficient, it is preferable that additional layers be formed as the light-absorption layers 11.

The light-absorption layers 11 result in absorbing the light incident onto the thin-film EL display panel to thereby reduce remarkably the light reflected by the counter electrode 13. In other words, it is observed that the counter electrode is nearly black from the side of the substrate 1. It is believed that the effects of absorbing the incident light result from discontinuous films of $Al_2O_3$ or $Al_2O_{3-x}$ according to the subsequent evaporation and from their interface in a manner similar to ceramic metal by the oxidation through the $O_2$ leakage.

The other materials such as Mo, Zr, Ti, Y, Ta, Ni and the like can be substituted for $Al_2O_3$ and $Al_2O_{3-x}$.

Figure 4:
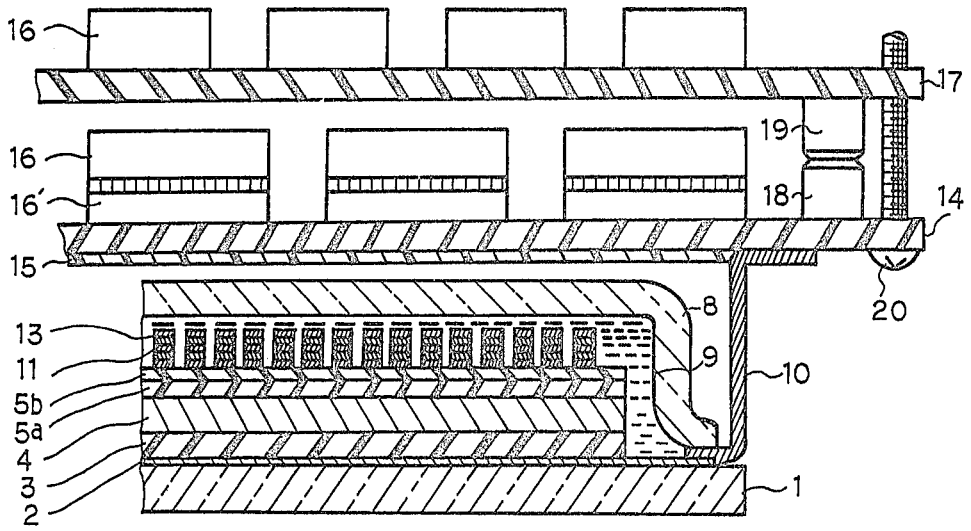
FIG. 4 is a cross-sectional view of still another thin-film electroluminescent display panel according to the present invention.

FIG. 4 shows still another thin-film EL display panel of the present invention which is further identical to that shown in FIG. 1, with the exception that there are used a plurality of the light-absorption layers 11 comprising at least one metallic film and at least one film including the common metal material in place of the first and second light-absorption layers 11 and 12 as indicated in FIG. 1. Like elements corresponding to those of FIG. 1 are indicated by like numerals.

Figure 5:
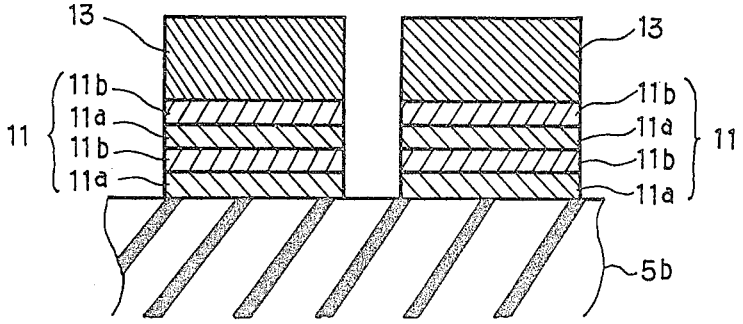
FIG. 5 is a cross-sectional view of an elongated portion including a counter electrode and a plurality of light-absorption layers, the portion being involved within the thin-film electroluminescent display panel illustrated in FIG. 4.

Referring to FIG. 5, the light-absorption layers 11 include two piled layers of a pair of a metallic films 11*a* made of Al and a film 11*b* made of Al and either $Al_2O_3$ or $Al_2O_{3-x}$, for example. The thickness of the metallic film 11*a* is about 60 Å and the other film 11*b* 30 Å. The metallic film 11*a* and the other film 11*b* are subsequently evaporated. To improve the light-absorbing effects of the films 11*a* and 11*b*, each of the films 11*a* and 11*b* should be less than 300 Å in thickness and, preferably, less than about 100 Å.

The light-absorption layers 11 may comprise two to five layers each made of 60 Å thin Al or the like.

The light-absorption layers 11 serve to absorb light incident upon the thin-film EL display panel reducing remarkably the quantity of light reaching the counter electrode 13 and quantity of light reflected by the same. The counter electrode 13 looks like a black background when observing the substrate 1.

Figure 6:
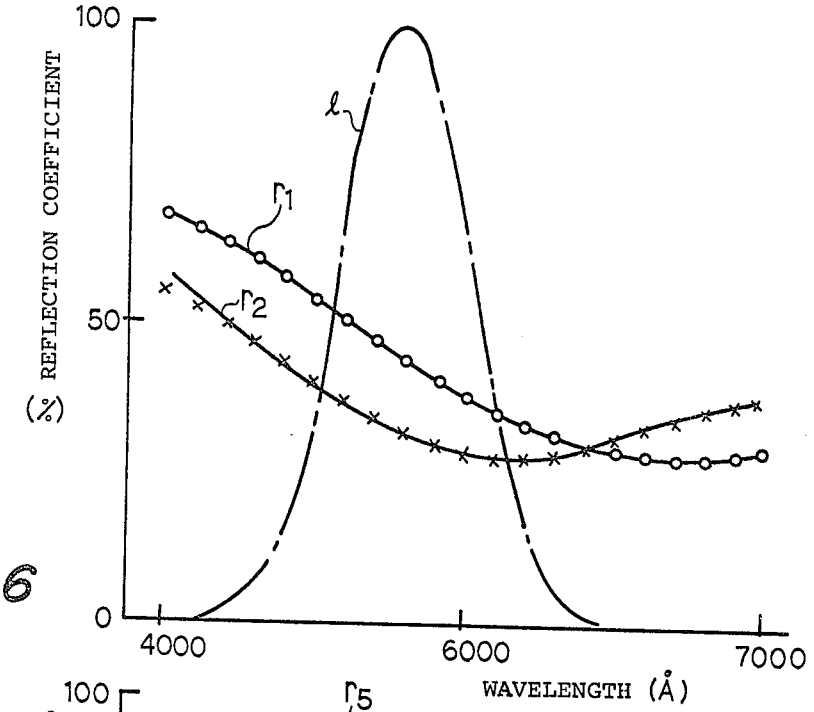
FIGS. 6 and 7 are graphs showing reflection properties in the thin-film electroluminescent display panel according to the present invention.
Figure 7:
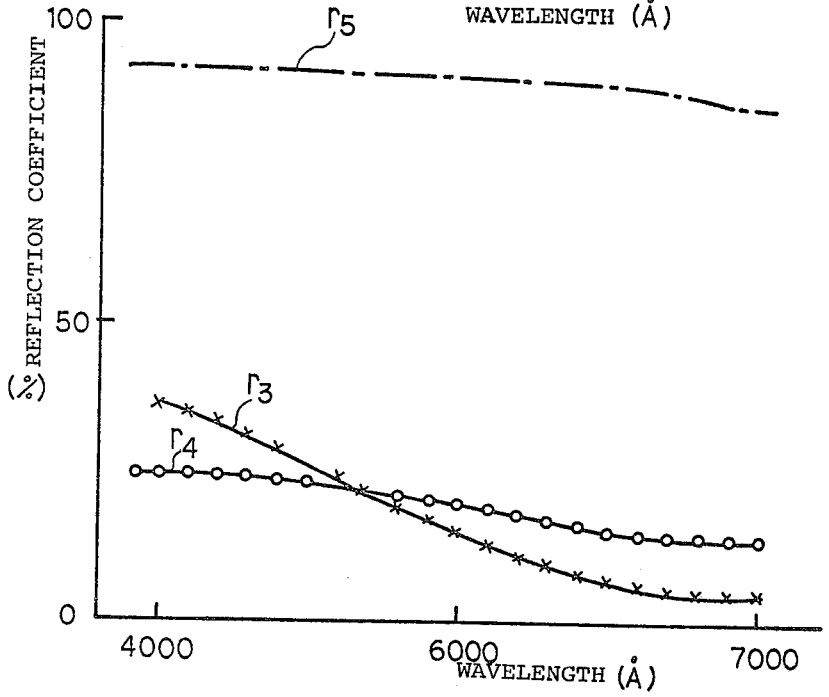

FIGS. 6 and 7 show graphs of wavelength (Å) v. light reflection coefficient (%) according to the present invention. The ordinate is concerned with the light reflection coefficient (%) and the abscissa the wavelength (Å).

With reference to FIG. 6, the data designate the spectra of emitted electroluminescence and data $r_1$ show reflection characteristics in the thin-film EL display panel where there are used two light-absorbing layers 11 each made of Al with a thickness of about 60 Å. The data bear the reflection characteristics in the thin-film EL display panel where there are formed two light-absorption layers 11 each made of Al with a thickness of about 40–50 Å.

With reference to FIG. 7, the data $r_3$ are related to the reflection characteristics in the thin-film EL display panel where three light-absorption layers 11 each made of Al with a thickness of about 60 Å are formed. The data $r_4$ are concerned with the same in the thin-film EL display panel where one film 11*b* made of Al and $Al_2O_3$ is interposed between two metal films 11*a* made of Al, all the films 11*a* and 11*b* being as thin as about 10–60 Å. The data $r_5$ represent the reflection coefficient of the counter electrode 13 A, of Al.

The reflection coefficients of the above were obtained as follows:

$r_1$: 44.4%
$r_2$: 32.9%
$r_3$: 19.8%
$r_4$: 21.4%

Although the present invention is described above according to the thin-film EL display panel including one layer of the EL thin-film, the present invention may be applied to the thin-film EL display panel containing a plurality of luminescent layers and/or front and counter electrodes. Other display devices such as liquid crystal displays, electrochromic displays, light emitting diode displays and the like may further contain the present invention.

While only certain embodiments of the present invention have been described, it will be apparent to those skilled in the art that various changes and modifications may be made therein without departing from the spirit and scope of the invention as claimed.

What is claimed is:

1. A display divice comprising:

a front electrode;

a counter electrode having reflective properties;

a light emission layer interposed between said front electrode and said counter electrode for providing light emission in response to a voltage applied across the front and counter electrodes;

light-absorption layer means positioned between the light emission layer and the counter electrode, said light-absorption layer means having light-absorption properties for absorbing light applied through the front electrode, said light-absorption layer means including a first thin film and a second thin film formed over said first thin film, said first thin film being selected from the group consisting of $Al_2O_3$ or $Al_2O_3$ -x, said second thin film formed over said first thin film selected from the group consisting of Mo, Zr, Ti, Y, Ta, or Ni.

2. The display device according to claim 1, wherein said light emission layer comprises a thin electroluminescent film including a luminescent center and wherein said display device further comprises first and second dielectric layers for sandwiching the thin electroluminescent film therebetween.

3. The display device according to claim 1, wherein each of the thin films of said light-absorption layer means has a thickness lying in a range from 10 Å to 300 Å.

4. A display device comprising:

a front electrode;

a counter electrode having reflective properties;

a light emission layer means interposed between said front electrode and said counter electrode for providing light emission in response to a voltage applied across the front and counter electrodes;

light-absorption layer means positioned between the light emission layer and the counter electrode for absorbing light applied thereto via said front electrode, said light-absorption layer means including a first light-absorption layer and a second light-absorption layer formed thereover, the first and second light-absorption layers including a metallic layer and a layer containing a metal common to the metallic layer and an oxidation material of said metal, respectively.

5. A display device in accordance with claim 4 wherein said first and second light-absorption layers contain a material selected from a group consisting of $Al_2O_3$, $Al_2O_{3-x}$, or Al, each of the first and second light-absorption layers having a thickness lying in a range from 10 Å to 300 Å.

6. A thin film electroluminescent display device comprising:

a front electrode;

a counter electrode having reflective properties; first and second dielectric layers disposed between said front electrode and said counter electrode;

a thin film electroluminescent layer disposed between the first and second dielectric layers, said thin electroluminescent layer including a luminescent center; and light-absorption layer means positioned between one of the dielectric layers and the counter electrode, said light-absorption layer means having light absorption properties for absorbing light applied thereto via said front electrode, said light-absorption layer means including a first light-absorption layer and a second light-absorption layer formed thereover, said first and second light-absorption layers including a metallic layer and a layer containing a metal common to said metallic layer and an oxidation material of said metal, respectively.

7. A thin film electroluminescent display device in accordance with claim 6 wherein said first and second light-absorption layers contain a material selected from a group consisting of $Al_2O_3$, $Al_2O_{3-x}$, or Al, each of the first and second light-absorption layers having a thickness lying in a range from 10 Å to 300 Å.

8. A display device having a display side and a rear side, comprising:

front electrode means positioned at said display side of said display device, said front electrode capable of permitting ambient light to pass therethrough;

counter electrode means positioned at said rear side of said display device;

light emission layer means interposed between said front electrode means and said counter electrode means for providing light emission in response to a voltage applied across the front and counter electrode means;

light-absorption layer means interposed between said front electrode means and said counter electrode means for absorbing the ambient light passing through said front electrode means thereby preventing the reflection of said ambient light off said counter electrode, said light-absorption layer means including at least a first thin film layer and a second thin film layer disposed over said first thin film layer, the first thin film layer is comprised of a material selected from the group consisting of $Al_2O_3$ or $Al_2O_{3-x}$, the second thin film layer is comprised of a material selected from the group consisting of Mo, Zr, Ti, Y, Ta, or Ni.

9. A display device in accordance with claim 8 wherein the thickness of each said thin film layer includes a thickness value lying in a range from 10 Å to 300 Å.

* * * * *